US009228271B2

(12) United States Patent
Liu

(10) Patent No.: US 9,228,271 B2
(45) Date of Patent: Jan. 5, 2016

(54) HANGING DEVICE FOR ANODIZING

(75) Inventor: Xiao-Qiang Liu, Shenzhen (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 1086 days.

(21) Appl. No.: 13/286,163

(22) Filed: Oct. 31, 2011

(65) Prior Publication Data

US 2012/0280443 A1 Nov. 8, 2012

(30) Foreign Application Priority Data

May 3, 2011 (CN) ..... 2011 1 0112570

(51) Int. Cl.
*C25D 11/00* (2006.01)
*C25D 17/06* (2006.01)

(52) U.S. Cl.
CPC ..... *C25D 11/005* (2013.01); *C25D 17/06* (2013.01)

(58) Field of Classification Search
CPC ..... B23Q 3/02; B23Q 7/046; B23Q 16/001; B23Q 2703/00; B23Q 2703/12
See application file for complete search history.

(56) References Cited

U.S. PATENT DOCUMENTS

| | | | | |
|---|---|---|---|---|
| 4,333,217 | A * | 6/1982 | Pray | 29/243.51 |
| 5,099,561 | A * | 3/1992 | Santiago Lozano | 29/237 |
| 5,487,538 | A * | 1/1996 | Tibbet | 269/71 |
| 5,961,109 | A * | 10/1999 | Dykstra et al. | 269/228 |
| 7,665,718 | B1 * | 2/2010 | Benson | 269/237 |
| 2009/0152786 | A1 * | 6/2009 | Iwata et al. | 269/89 |
| 2010/0117281 | A1 * | 5/2010 | Doyle | 269/97 |
| 2012/0280443 | A1 * | 11/2012 | Liu | 269/90 |
| 2012/0291247 | A1 * | 11/2012 | Wang | 29/281.1 |

* cited by examiner

*Primary Examiner* — Lee D Wilson
(74) *Attorney, Agent, or Firm* — Novak Druce Connolly Bove + Quigg LLP

(57) ABSTRACT

A device for hanging a workpiece for anodizing includes a hanging member for fixing the workpiece, a positioning assembly, a latching assembly mounted on the positioning assembly, and a connecting rod assembly. The hanging member includes a latching end. The positioning assembly and the latching assembly cooperatively defines a latching space for positioning the hanging member. The connecting rod assembly includes a cam pivoted with the latching assembly, and a rod fixed with the cam. The cam includes a resisting end. The latching end of the hanging member is latched in the latching space. The cam is rotatable by means of the rod, such that the rod is capable of driving the resisting end of the cam to resist on the latching end to fix the hanging member, or to move away from the latching end to release the hanging member.

16 Claims, 5 Drawing Sheets

HANGING DEVICE FOR ANODIZING

BACKGROUND

1. Technical Field

The present disclosure generally relates to hanging devices, and more particularly to a device from which items for anodizing can be hung.

2. Description of Related Art

Aluminum workpieces may be anodized to protect the bare aluminum and for appearance. In an aluminum anodizing process, the aluminum workpieces are suspended on a hanging device. The hanging device with the aluminum workpieces are submerged in an electrolyte solution, such as a vitriolic solution. When the hanging device is electrically connected to an anode of an electrical source, the aluminum workpieces can be anodized in the electrolyte solution.

Generally, the hanging device includes a fixing portion to be fixed on a fixing frame and a hooking portion connected to the fixing portion for hanging the workpiece. However, the fixing portion usually has a curved structure. In use, the fixing portion is hooked on the fixing frame, and then fixed to the fixing frame by several fasteners. Therefore, it is inconvenient to fix or detach the hanging device from the fixing frame.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views, and all the views are schematic.

DETAILED DESCRIPTION

Figure 1:
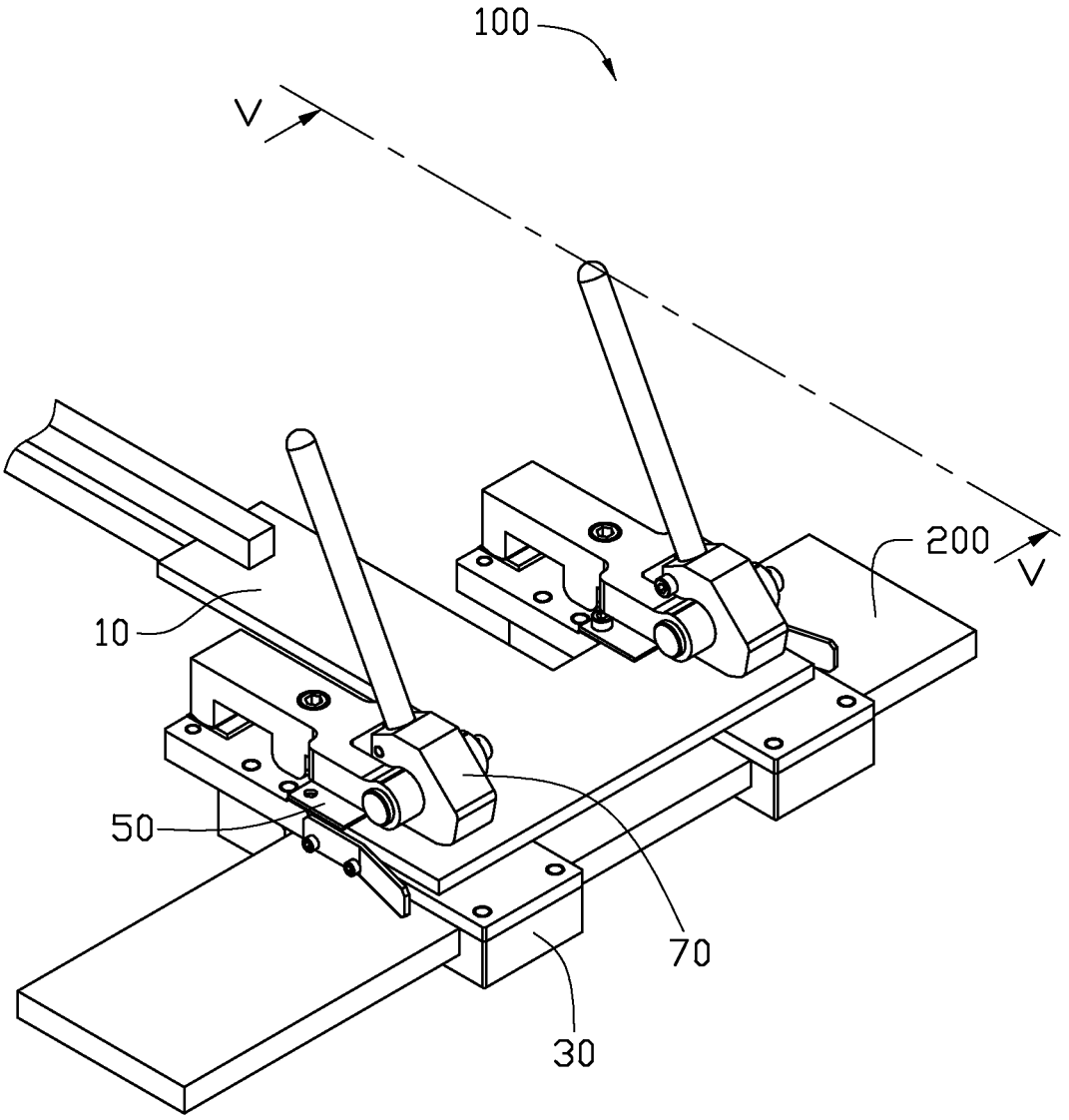
FIG. 1 shows an assembled, isometric view of one embodiment of a hanging device, the hanging device includes a hanging member, a pair of positioning assemblies, a pair of latching assemblies and a pair of connecting rod assemblies.

Referring to FIG. 1, an embodiment of a hanging device 100 is shown. The hanging device 100 includes a hanging member 10, a pair of positioning assemblies 30, a pair of latching assemblies 50, and a pair of connecting rod assemblies 70. In the illustrated embodiment, the positioning assemblies 30 are fixed on a supporting frame 200. The supporting frame 200 is substantially a fixed plate in an anodizing line, for positioning the hanging device 100. Each latching assembly 50 is mounted on a positioning assembly 30. Each connecting rod assembly 70 is mounted on a latching assembly 50. The hanging member 10 is positioned on the positioning assemblies 30 and fixed by the connecting rod assemblies 70 and the latching assemblies 50.

Figure 2:
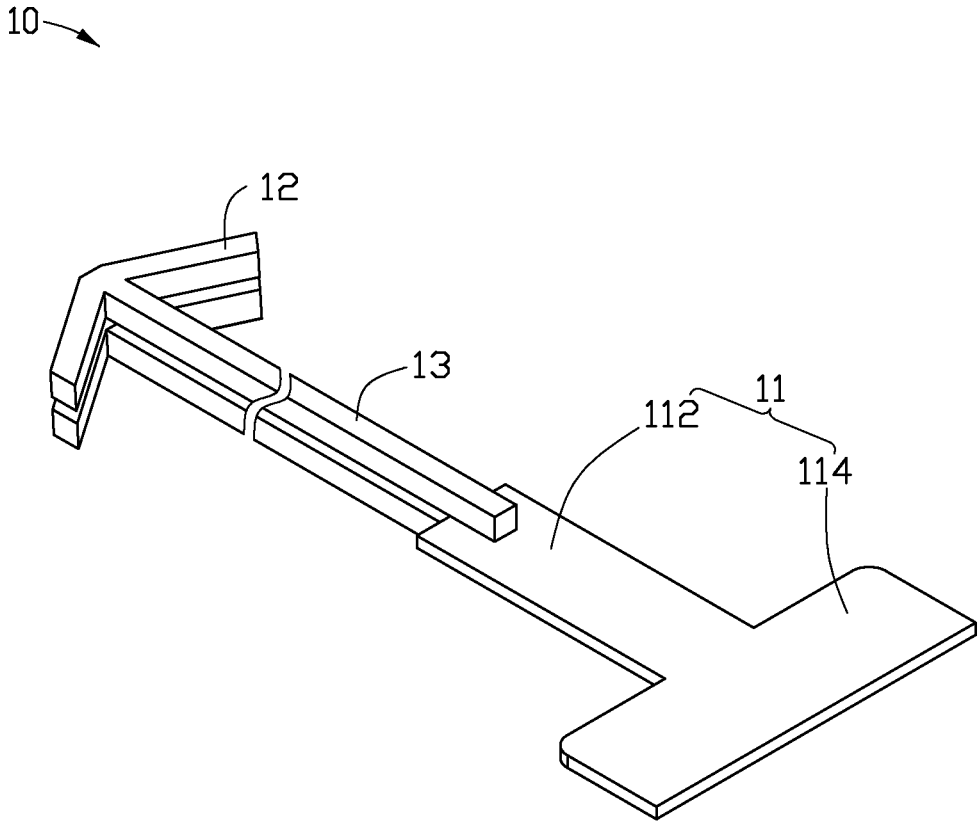
FIG. 2 shows an enlarged, isometric view of the hanging member of FIG. 1.

Referring to FIG. 2, the hanging member 10 includes a latching end 11, a hooking end 12 opposite to the latching end 11 for suspending a plurality of workpieces, and a connecting rod 13 interconnecting the hooking end 12 and the latching end 11. The latching end 11 is substantially a "T" shaped board, and includes a main body 112 and a latching portion 114. One end of the body 112 connects to a substantially middle portion of the latching portion 114, and the other end of the body 112 connects to the connecting rod 13. The two ends of the latching portion 114 can be positioned on the pair of the positioning assemblies 30, and can be fixed by the connecting rod assemblies 70 and the latching assemblies 50.

Figure 3:
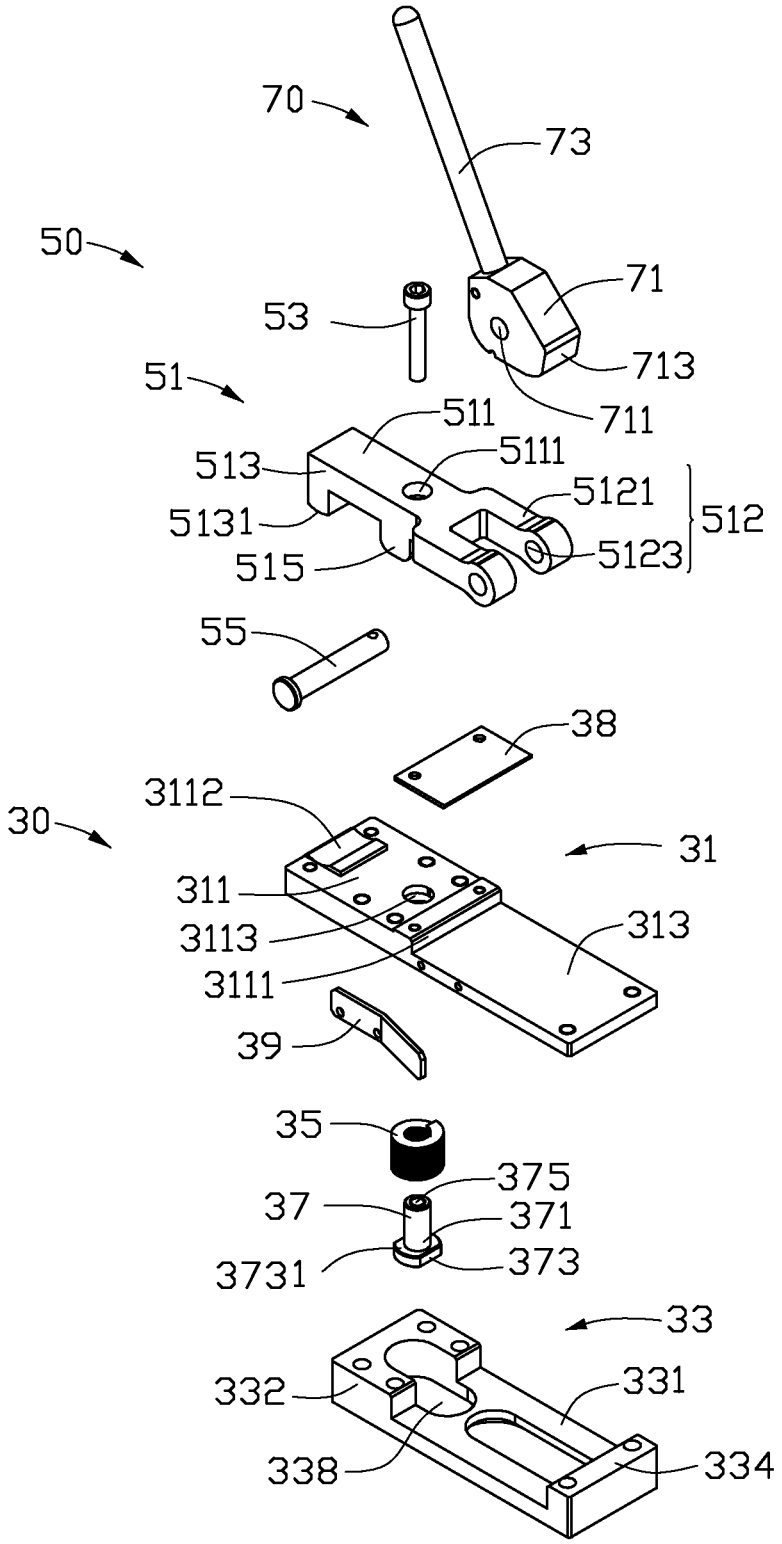
FIG. 3 shows an exploded, isometric view of part of one of the positioning assemblies of the hanging device of FIG. 1, the positioning assembly includes a first mounting member.
Figure 4:
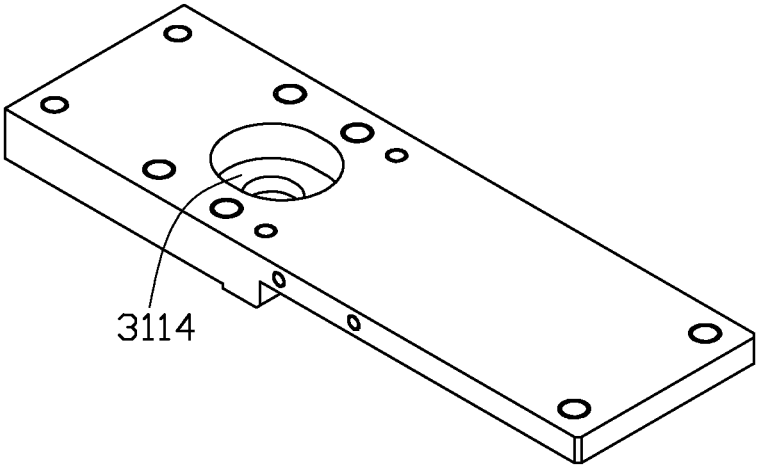
FIG. 4 shows an enlarged, isometric view of the first mounting member of FIG. 3.
Figure 5:
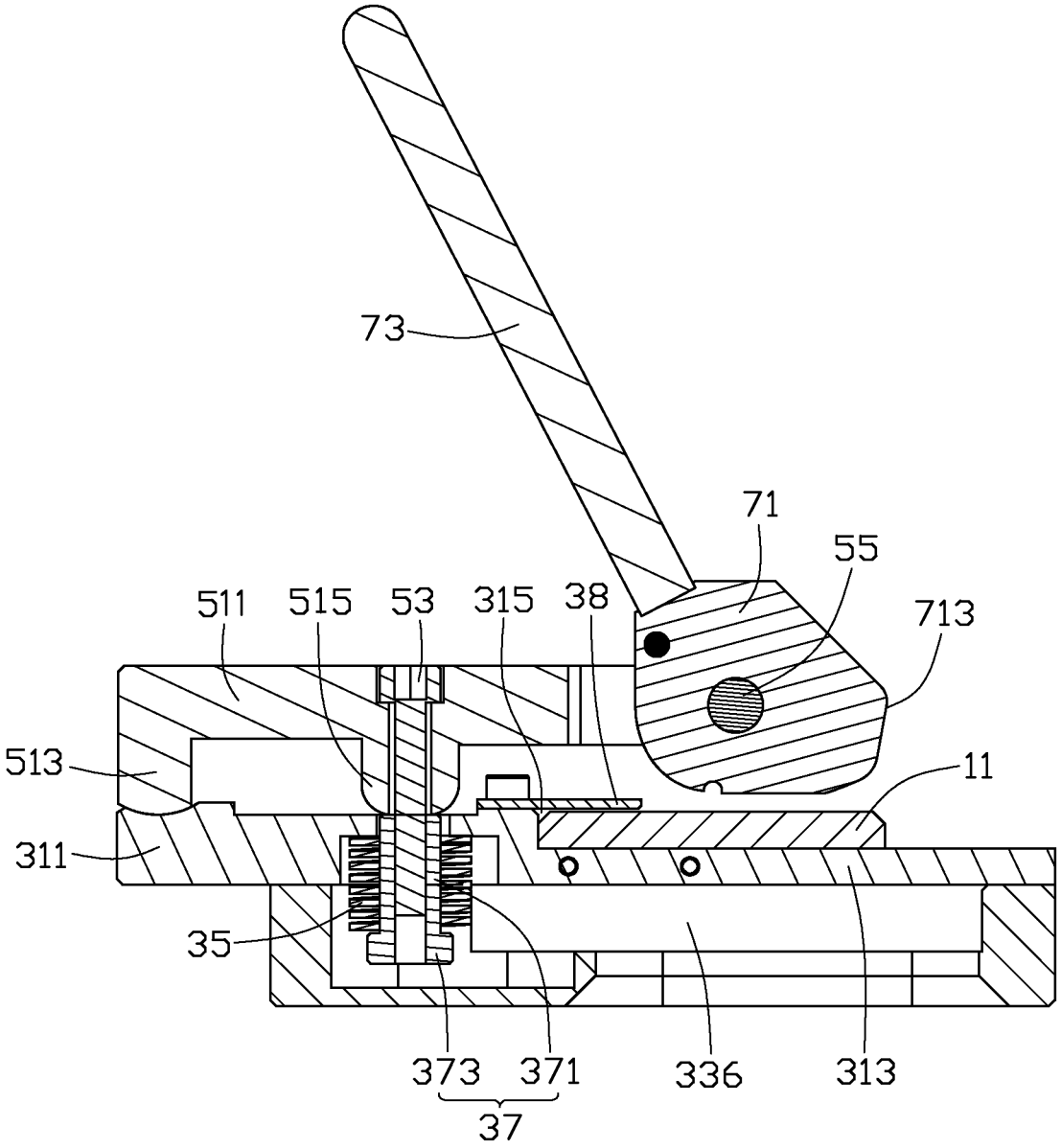
FIG. 5 shows a cross-section of the hanging device of FIG. 1, taken along line V-V.

Also referring to FIGS. 3 through 5, each positioning assembly 30 includes a first mounting member 31, a second mounting member 33, an elastic member 35, a stopping member 37, a latching member 38, and a stopping strip 39. The second mounting member 33 is fixed to the first mounting member 31 to define a receiving chamber 336 to allow the supporting frame 200 to pass through. The elastic member 36 and the stopping member 37 are engaged between the first mounting member 31 and the second mounting member 33. The latching member 38 and the stopping strip 39 are mounted on the first mounting member 31.

The first mounting member 31 includes a main body 311, and a resisting plate 313 extending from an end of the body 311. The body 311 and the resisting plate 313 are substantially cuboid, and the body 311 is elevated in relation to the resisting plate 313. In other words, the body 311 forms a stopping portion 3111 at the end adjacent to the resisting plate 313. The body 311 further defines a valley portion 3112 at the end away from the resisting plate 313, and a stepped through hole 3113 through the body 311 near the stopping portion 3111. The stepped through hole 3113 defines a stepped surface 3114 at the opposite side of the valley portion 3112.

The second mounting member 33 includes a main body 331, a first protrusion portion 332 and a second protrusion portion 334. The first protrusion portion 332 and the second protrusion portion 334 protrude from the ends of the surface of the body 331 facing the first mounting member 31. The first protrusion portion 332 is fixed to the body 311 between the valley portion 3112 and the stepped through hole 3113 via a plurality of fasteners (not shown). The second protrusion portion 334 is fixed to the end of the resisting plate 313 away from the body 311 via a plurality of fasteners (not shown). In this way, the receiving chamber 336 is cooperatively defined by the first mounting member 31 and the second mounting member 33 for latching the supporting frame 200. The body 331 and the first protrusion portion 332 cooperatively define a groove 338, to contain the elastic member 35 and the stopping member 37.

In the illustrated embodiment, the stopping member 37 includes a fixing portion 371, a flange portion 373 perpendicularly extending from an end of the fixing portion 371, and a through hole 375 in the fixing portion 371 and the flange portion 373. The fixing portion 371 is substantially columnar. The elastic member 35 is a columnar spring, and is sleeved on the fixing portion 371 of the stopping member 37. The flange portion 373 forms a resisting surface 3731 perpendicular to the fixing portion 371. The resisting surface 3731 abuts the elastic member 35.

In the illustrated embodiment, the latching member 38 is a thin plate, mounted on the end of the body 311 near the stopping portion 3111, and parallel to the resisting plate 313. A stopping strip 39 is mounted on a side of the resisting plate 313 of the body 311 near the stopping portion 3111, the stopping strip 39 is substantially a thin bent plate. The stopping portion 3111, the resisting plate 313, the latching member 38, and the stopping strip 39 cooperatively define a latching space 315 (see FIG. 5) for latching the latching portion 114 of the hanging member 10.

Each latching assembly 50 is used to connect the positioning assembly 30 with the connecting rod assemblies 70, and includes a supporting member 51, a fastener 53 and a pivoting component 55. The fastener 53 fixes the supporting member 51 to the stopping member 37 through the stepped through hole 3113. The pivoting component 55 enables the connecting rod assemblies 70 to pivot on the supporting member 51.

The supporting member 51 includes a main body 511, a pair of pivoting members 512 extending from an end of the body 511, a first protruding portion 513, and a second protruding portion 515. The first protruding portion 513 protrudes from one end of the body 511 and away from the pivoting member 512. The second protruding portion 515 protrudes from the other end of the body 511 adjacent to the pivoting member 512 to correspond to the stepped through hole 3114. The body 511 defines a through hole 5111 through the second protruding portion 515, and communicates with the stepped through hole 3114. The pivoting members 512 extend from the body 511 and face each other, and hold the pivoting component 55 in place. Each pivoting member 512 includes an extending portion 5121 extending from the body 511, and a pivoting hole 5123 through the distal end of the extending portion 5121.

The first protruding portion 513 perpendicularly protrudes out from the body 511, and forms a convex end 5131 to correspond with the valley portion 3112. The second protruding portion 515 perpendicularly protrudes out from the body 511 in the same direction and at the same height as the first protruding portion 513. In the illustrated embodiment, the fastener 53 is a screw, and the length of the fastener 53 is longer than the through hole 5111. The pivoting component 55 is a rod to fit the pivoting holes 5123.

Each of the connecting rod assemblies 70 includes a cam 71 and a rod 73 fixed on the cam 71. The cam 71 defines a pivoting hole 711 to align with the pivoting hole 5123, and there is a resisting end 713 on the end of the cam 71. The distance between the pivoting hole 711 and the resisting end 713 is longer than the distance between the pivoting hole 711 and the surface of the latching portion 114.

In assembly, first, the latching member 38 is fixed on the end of the body 311 parallel to the resisting plate 313, and the stopping strip 39 is fixed on a side of the body 311 perpendicular to the resisting plate 313. Thus, the body 311, the resisting plate 313, the latching member 38 and the stopping strip 39 cooperatively define the latching space 315.

Second, the elastic member 35 is sleeved on fixing portion 371, and the resisting surface 3731 abuts the elastic member 35.

Third, the supporting member 51 is placed on the first mounting member 31. The through hole 5111 is aligned with the through hole 375. The second protruding portion 515 abuts the body 311, and the convex end 5131 rests in the valley portion 3112. The fastener 53 is inserted through the through hole 5111 and the through hole 735, and fixes the supporting member 51 to the stopping member 37. Thus, the elastic member 35 is sandwiched between the stepped surface 3114 and the flange portion 373.

Fourth, the rod 73 is fixed on the cam 71. The cam 71 is placed between the pair of pivoting members 512, and the pivoting hole 711 is aligned with the pivoting hole 5123. The pivoting component 55 is inserted into the pivoting hole 711 and the pivoting hole 523.

Fifth, the flange portion 373 is positioned in the groove 338. The first protruding portion 332 is fixed to the body 311, and the second protruding portion 334 is fixed to the resisting plate 313. The first mounting member 31 and the second mounting member 33 define the receiving chamber 336 in which the supporting frame 200 is secured. At this time, the positioning assembly 30, the connecting member 50 and the second mounting member 70 are assembled together and fixed on the supporting frame 200.

Finally, the two ends of the latching portion 114 are latched in the receiving chamber 315 and supported on the stopping portion 3111.

In use, the hanging member 10 is placed on the stopping portion 3111, and the latching member 38 and the stopping strip 39 prevent the hanging member 10 from falling off the receiving chamber 315. The workpiece is hooked on the hooking end 12. The rod 73 is pulled back to drive the cam 71 to rotate, and the resisting end 713 moves towards the latching portion 114 until the resisting end 713 resists on the latching portion 114. The distance between the pivoting hole 711 and the resisting end 713 being longer than the distance between the pivoting hole 711 and the latching portion 114, the supporting member 55 is forced to move away from the first mounting member 31. The fastener 53 pulls the fixing portion 371 across the stepped through hole 3113, and the elastic member 35 is compressed. The hanging member 10 is fixed in place because the latching portion 114 is latched in the latching space 315 and resisted by the resisting end 713.

To disengage, the rod 73 is pushed forward to rotate the cam back, and the resisting end 713 moves away from the latching portion 114. The supporting member 51 and the stopping member 37 move back. The elastic member 35 extends. The hanging member 10 can thus be detached easily from the latching space 315.

The pulling or pushing forces required to move the rod depend upon the strength of the elastic member 35 and different elastic members 35 with different elasticity can be used. The number of the positioning assemblies, the latching assemblies, and the connecting rod assemblies can be one or more than one, with the shape of the latching portion 114 changing accordingly.

By pulling the rod 73, the resisting end 713 presses against or moves away from the latching portion 114, thus the hanging member 10 can be fixed in place or released. In other words, the hanging member 10 is very easily operated. The elastic member 35 is capable of releasing the force resisted on the first mounting member 31 by the resisting end 713, to minimize the damage to the latching portion 114.

Finally, while various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. A hanging device for hanging a workpiece for anodizing, comprising:

a hanging member, the hanging member comprising a latching end and a hooking end opposite to the latching end for hooking the workpiece;

a positioning assembly;

a latching assembly mounted on the positioning assembly, the positioning assembly and the latching assembly cooperatively defining a latching space for positioning the hanging member;

a connecting rod assembly comprising a cam pivoted with the latching assembly, and a rod fixed with the cam, the cam comprising a resisting end;

wherein the latching end of the hanging member is latched in the latching space; the cam is rotatable with the rod, such that the rod drives the resisting end of the cam to resist on the latching end to fix the hanging member, or to move away from the latching end to release the hanging member.

2. The hanging device of claim 1, wherein the positioning assembly comprises a first mounting member and a latching member mounted on the first mounting member; a stopping portion is defined on the first mounting member to prevent the hanging member from disengaging from the latching space.

3. The hanging device of claim 2, wherein the positioning assembly further comprises a stopping strip mounted on a side of the first mounting member near the stopping portion to prevent the hanging member from sliding out from the latching space from a side.

4. The hanging device of claim 2, wherein the hanging device is hung on a fixing frame; the positioning assembly further comprises a second mounting member; the first mounting member and the second mounting member cooperatively define a receiving chamber to allow the hanging device to be latched with the fixing frame for suspending the hanging device.

5. The hanging device of claim 4, wherein the positioning assembly further comprises a stopping member and an elastic member mounted between the first mounting member and the second mounting member; the stopping member comprises a fixing portion and a flange portion form at an end of the fixing portion; the flange portion resists on an end of the elastic member; the first mounting member defines a stepped through hole, and the stepped through hole defines a stepped surface; the other end of the elastic member resists on the stepped surface; the latching assembly comprises a supporting member and a fastener; the fastener fixes the supporting member with the fixing portion through the stepped through hole.

6. The hanging device of claim 5, wherein the supporting member comprising a main body, a first protruding portion, and a second protruding portion; the first protruding portion protrudes from one end of the main body, and the second protruding portion protrudes from the other end of the main body corresponding to the stepped through hole; the first protruding portion and the second protruding portion are resisted on the first mounting member; the second protruding portion is fixed with the fixing portion.

7. The hanging device of claim 6, wherein the first protruding portion defines a convex end; the first mounting member defines a valley portion corresponding to the convex end; the valley portion resists on the convex end.

8. The hanging device of claim 7, wherein the latching assembly further comprises a pivoting component; the supporting member further comprises an extending portion extending at an end of the main body away from the first protruding portion; the cam defines a pivoting hole; the pivoting component pivots the cam with the extending portion through the pivoting hole; a distance between the pivoting hole and the resisting end is longer than a distance between the pivoting hole and the latching portion.

9. A hanging device for hanging a workpiece for anodizing, comprising:

a hanging member, the hanging member comprising a latching end and a hooking end opposite to the latching end for hooking the workpiece;

a positioning assembly defining a stopping portion for positioning the hanging member;

a latching assembly mounted on the positioning assembly;

a connecting rod assembly comprising a cam pivoted with the latching assembly, and a rod fixed with the cam, the cam comprising a resisting end;

wherein the latching end of the hanging member is positioned on the stopping portion; the cam is rotatable with the movable of the rod, such that the rod is capable of driving the resisting end of the cam to resist on the latching end to fix the hanging member, or to move away from the latching end to release the hanging member.

10. The hanging device of claim 9, wherein the positioning assembly comprises a first mounting member and a latching member mounted on the first mounting member; the first mounting member and the latching member cooperatively define a latching space; the latching end is latched in the latching space; a stopping portion is defined on the first mounting member to prevent the hanging member from disengaging from the latching space.

11. The hanging device of claim 10, wherein the positioning assembly further comprises a stopping strip mounted on a side of the first mounting member near the stopping portion to prevent the hanging member from sliding out from the latching space from a side.

12. The hanging device of claim 10, wherein the hanging device is hung on a fixing frame; the positioning assembly further comprises a second mounting member; the first mounting member and the second mounting member cooperatively define a receiving chamber to allow the hanging device to be latched with the fixing frame for suspending the hanging device.

13. The hanging device of claim 12, wherein the positioning assembly further comprises a stopping member and an elastic member mounted between the first mounting member and the second mounting member; the stopping member comprises a fixing portion and a flange portion form at an end of the fixing portion; the flange portion resists on an end of the elastic member; the first mounting member defines a stepped through hole, and the stepped through hole defines a stepped surface; the other end of the elastic member resists on the stepped surface; the latching assembly comprises a supporting member and a fastener; the fastener fixes the supporting member with the fixing portion through the stepped through hole.

14. The hanging device of claim 13, wherein the supporting member comprising a main body, a first protruding portion, and a second protruding portion; the first protruding portion protrudes from one end of the main body, and the second protruding portion protrudes from the other end of the main body corresponding to the stepped through hole; the first protruding portion and the second protruding portion are resisted on the first mounting member; the second protruding portion is fixed with the fixing portion.

15. The hanging device of claim 14, wherein the first protruding portion defines a convex end; the first mounting member defines a valley portion corresponding to the convex end; the valley portion resists on the convex end.

16. The hanging device of claim 15, wherein the latching assembly further comprises a pivoting component; the supporting member further comprises an extending portion extending at an end of the main body away from the first protruding portion; the cam defines a pivoting hole; the pivoting component pivots the cam with the extending portion through the pivoting hole; a distance between the pivoting hole and the resisting end is longer than a distance between the pivoting hole and the latching portion.

* * * * *